United States Patent [19]

Bode

[11] Patent Number: 4,926,854

[45] Date of Patent: May 22, 1990

[54] PROTECTIVE HELMET WITH A STRAPLESS BREATHING PROTECTION MASK

[75] Inventor: Sven Bode, Berlin, Fed. Rep. of Germany

[73] Assignee: Sven Bode, Auergesellschaft GmbH, Berlin, Fed. Rep. of Germany

[21] Appl. No.: 210,655

[22] Filed: Jun. 23, 1988

[30] Foreign Application Priority Data

Jun. 26, 1987 [DE] Fed. Rep. of Germany ..... 3721662

[51] Int. Cl.[5] ..... A62B 17/04; A62B 3/00; A42B 300

[52] U.S. Cl. ..... 128/201.23; 24/636; 24/651; 2/6; 2/422

[58] Field of Search ..... 2/6, 9, 10, 422, 424, 2/425, 426, 427, 428, 431, 442; 24/633, 636, 637, 651, 684; 128/201.22, 201.23, 201.24, 201.25

[56] References Cited

U.S. PATENT DOCUMENTS

| | | | |
|---|---|---|---|
| 3,050,736 | 8/1962 | Malcom, Jr. | 2/9 |
| 3,790,994 | 2/1974 | Jakob | 24/637 |
| 3,921,262 | 11/1975 | Tanaka | 24/637 |
| 4,136,403 | 1/1979 | Walther et al. | 2/10 |
| 4,731,912 | 3/1988 | Boriskie et al. | 24/633 |

*Primary Examiner*—Wm. Carter Reynolds

*Attorney, Agent, or Firm*—Reed Smith Shaw & McClay

[57] ABSTRACT

A protective helmet with a strapless breathing protection mask which is in detachable connection therewith. The detachable connection is formed by connecting elements that can be plugged into each other and locked, and these connecting elements are located at both sides of the helmet and of the mask. The connecting elements include a flexible plug-type part capable of limited rotation and arranged on the breathing protection mask and a plug receptacle part with an adjusting device arranged on the protective helmet. In order to establish the detachable connection of the mask with the protective helmet, the plug part is plugged into the plug receptacle part becoming automatically locked therewith.

13 Claims, 4 Drawing Sheets

PROTECTIVE HELMET WITH A STRAPLESS BREATHING PROTECTION MASK

FIELD OF THE INVENTION

The present invention concerns a protective helmet with a strapless breathing protection mask in a detachable connection.

BACKGROUND OF THE INVENTION

In the case of a known protective helmet, plug-in and lockable holding means are provided in detachable connection on both side surfaces of the protective helmet and of the breathing protection mask as described in German patent DE-PS 2640 701, (corresponding to U.S. Pat. No. 4,136,403 Walthor et al.).The holding means consists of a tension slide arranged on the protective helmet with an oval/funnel-shaped reception part and a coupling pin on the breathing protection mask. In order to establish the connection between the breathing protection mask and the protective helmet, the coupling pins, provided with unlockable locking balls, are inserted into the funnel-shaped reception parts and are locked there. For individual adjustment and tightening of the mask to the surrounding sealing line on the face, the tension slides have to be moved backwards from the face, whereby, with the aid of a roller pushed along a slanted plane, the breathing protection mask is locked in a corresponding position at the wall of the protective helmet. This type of locking is positive and form-fitting, however; there is the danger that in the course of time when worn this way, the connection between the mask and the protective helmet will loosen, so that the surrounding sealing line of the mask on the face will become leaky. Another disadvantage of this version of protective helmet is that the plugged-in connecting elements represent a relatively rigid connection between the mask and the protective helmet. Facial movements, movements when the user is speaking or possible occurring displacement movements caused by the effects of forces on the helmet, cannot be compensated for.

It is therefore the purpose of this invention to create a protective helmet with a strapless breathing protection mask in a detachable connection, where during use the connection between the mask and the protective helmet guarantees a permanent safe sealing of the mask on the face, and where all movements occurring between the mask and the protective helmet are compensated for.

The advantages achieved with the invention are particularly due to the fact that when the protective helmet is worn, the mask can be connected to the protective helmet in a fast and uncomplicated manner, whereby the individual adjustment and sealing of the mask to the face can be accomplished automatically with the means provided in the connecting element, and where all movements of the detachable assembled parts can be compensated for in a harmonic fashion.

SUMMARY OF THE INVENTION

The present invention pertains to a protective helmet with a strapless breathing protection mask in a detachable connection. The detachable connection is formed by plug-in type and lockable connecting elements arranged on both sides of the helmet and the mask. The improvement to the detachable connection includes each connecting element having a flexible plug-type part capable of limited rotation which is arranged on the breathing protection mask, and of a plug receptacle part arranged on the protective helmet. The plug receptacle part has an adjusting device which can be adjusted to a number of different positions, and which holds the plug-type part in the plug receptacle part with positive force. The plug-type part is inserted into the plug receptacle part to form the detachable connection and the adjusting device allows the mask and helmet to be arranged with a tight fit on the face of a user.

BRIEF DESCRIPTION OF THE DRAWINGS

In the accompanying drawings, preferred embodiments of the invention and preferred methods of practicing the invention are illustrated, in which.

DESCRIPTION OF THE PREFERRED EMBODIMENT

Figure 1:
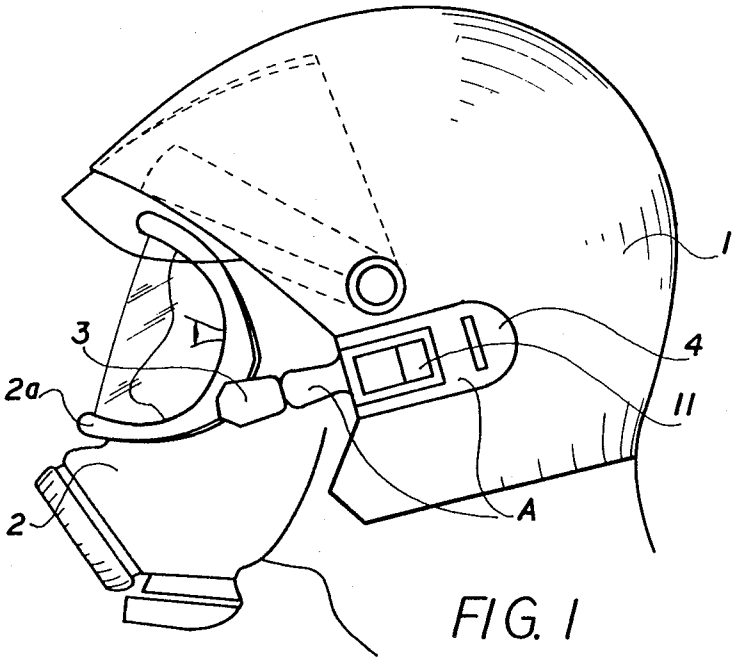
FIG. 1 is a lateral view of the protective helmet with breathing protection mask and a connecting device according to the invention, in the condition as used by the wearer.
Figure 2:
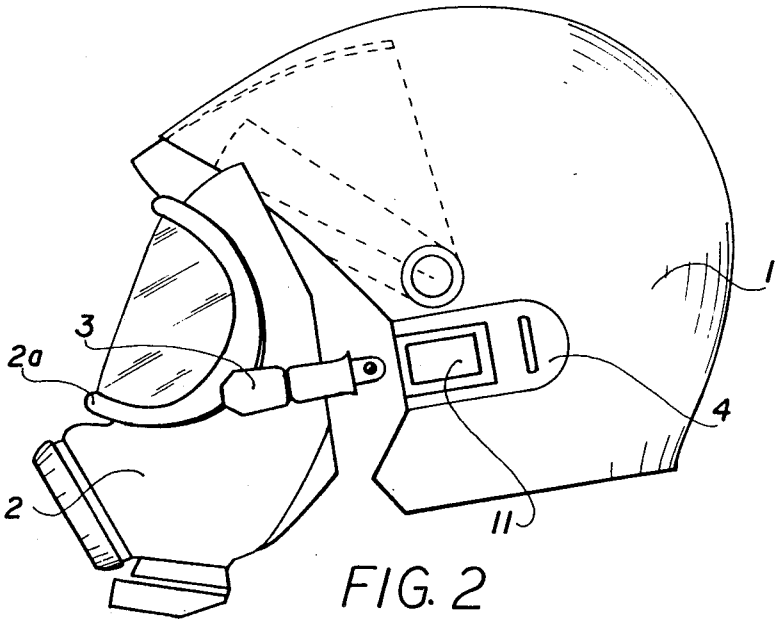
FIG. 2 is a lateral view of the protective helmet with breathing protection mask and connecting device, where the helmet and the mask are separated from each other.

Referring to FIG. 1, there is shown a protective helmet 1, worn by a user, with a breathing protection mask 2 in position, where, arranged on either side of the mask 2, is a detachable connecting element A which provides connection between the protective helmet 1 and the breathing protection mask 2. The connecting element A essentially consists of two parts, namely of a plug part 3 mounted in articulated fashion on the breathing protection mask 2 at the frame of the looking glass 2*a*, and of the plug receptacle part 4 arranged on the protective helmet 1 (see FIG. 2).

Figure 3:
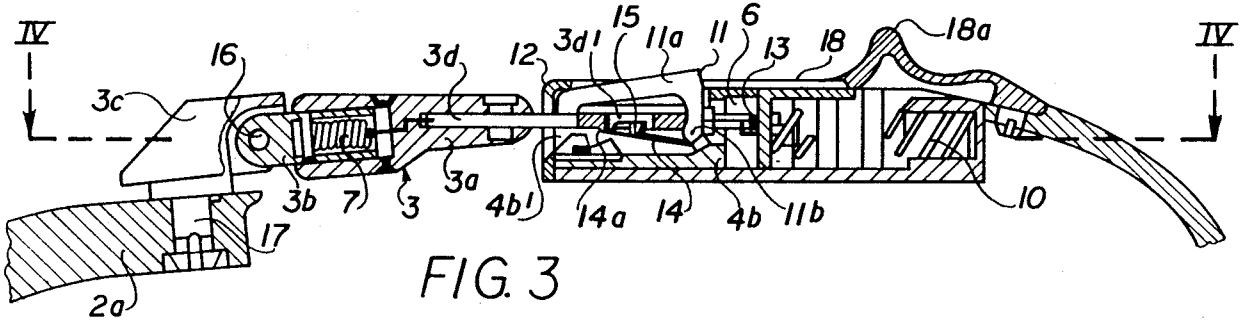
FIG. 3 is a lateral view of a cross-section of the connecting device, where a plug part of the breathing protection mask is engaged in a plug receptacle part of the protective helmet in a first locking position.
Figure 4:
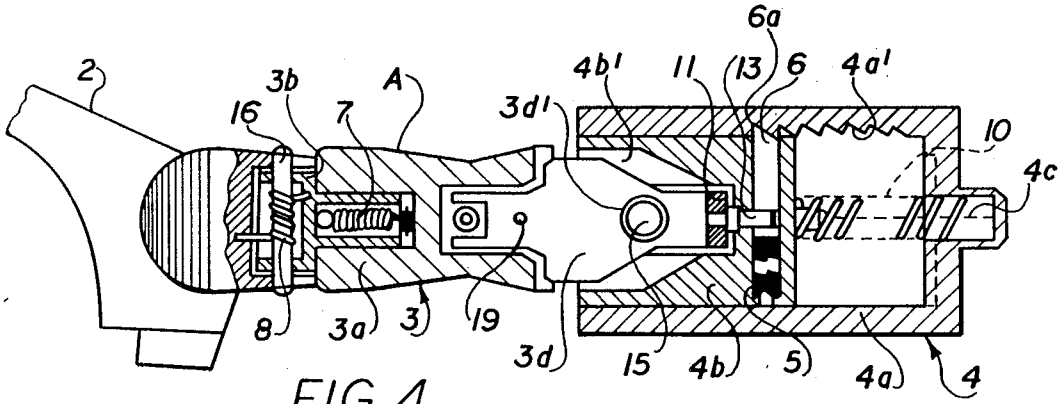
FIG. 4 is a sectional view along the line IV—IV of FIG. 3.
Figure 5:
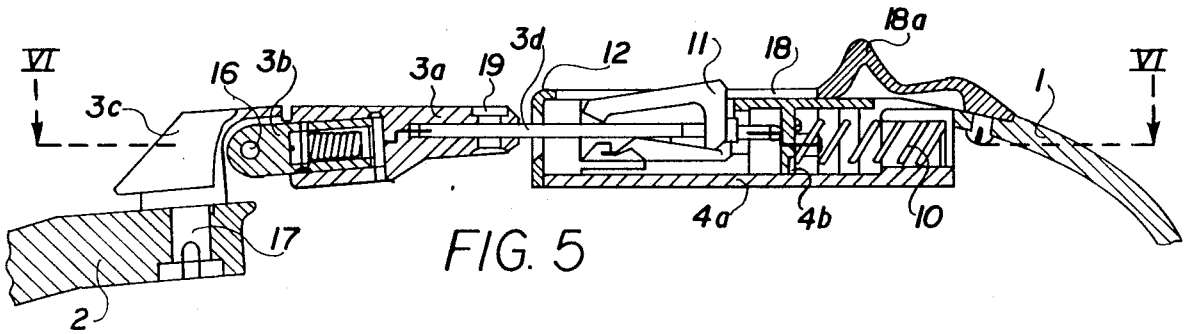
FIG. 5 is a lateral view of a cross-section of the connecting device, where the plug part is engaged in the plug receptacle part in another possible locking position.

The plug receptacle part 4 consists of a housing 4*a* having a U-shaped cross-section. A moveable slide 4*b* is disposed in the U-shaped cross-section of the housing as is a spring 10. The slide 4*b* is moveable against the force of a spring 10 and is so arranged, that it can be moved optionally into predetermined positions, where it is locked with positive force (see FIGS. 3 to 6). In the slide 4*b*, a moveable locking element 6, being under the pressure of a second spring 5, is arranged transverse to the longitudinal axis 4*c* of the slide 4*b*. The locking element 6 has a sawtooth-shaped point 6*a*, which, interacts with positive force with toothed recesses 4*a*', provided in the locking 4*a*. The sawtooth-shaped point 6*a* of the housing element 6, during a longitudinal move of the slide 4*b* against the force of the spring 10 in the direction towards the protective helmet 1, engages automatically into the recess 4a', corresponding to the desired position (see FIGS. 4, 6 and 7). p The release of the locking element 6 from the respective recess 4a', and therefore the release of the slide 4b locked in the housing 4a and the move to another position within the housing takes place by means of a key 11 which is unilaterally supported in a bearing 12 in the slide (FIG. 3 and 5). The key 11 has an L-shaped design and is supported in the bearing 12 with one end of the long leg section 11a of the key 11, whereas the short leg section 11b of the key 11 has a protruding pin 13. The pin 13 interacts with a longitudinal hole 6b which is provided at a slant angle in the locking element 6.

When the key 11 is pressed down, the pin 13 guided in the slanted longitudinal hole 6b of the locking element 6 moves vertically downwards against the force of the spring 5 from the respective recess 4a and releases the locking element, which is arranged transverse to the longitudinal axis of the slide 4b. The slide 4b with the locking element 6 is thus released from its locking position in the housing 4a and is pressed by the force of the spring 10 into a final position, locking in a forward direction (see FIGS. 3 and 4).

Below the key 11, a leaf spring 14 interacting with the key 11, is arranged in the slide 4b. The leaf spring 14, mounted with one end 14a in the slide 4b, pushes with the free end 14b with spring action against the short leg section 11b of the key 11 and holds it in a resting position.

On the leaf spring 14, near the mounted end 14a, a cog 15 is arranged on which the plug part 3 by means of a tongue-like plug element 3d engages the plug receptacle part 4 in order to connect therewith. The plug element 3d has a through-hole, 3d' into which the cog 15 captively engages, namely when the plug element 3d is inserted through an opening 4b' provided in the slide 4b. The connection of the plug part 3 with the plug receptacle part 4 established in this way can be released by pressing down the spring loaded key 11. In this case the cog 15 arranged on the leaf spring 14 moves out of the through-hole 3d and releases the plug element 3d of the plug part 3.

Figure 6:
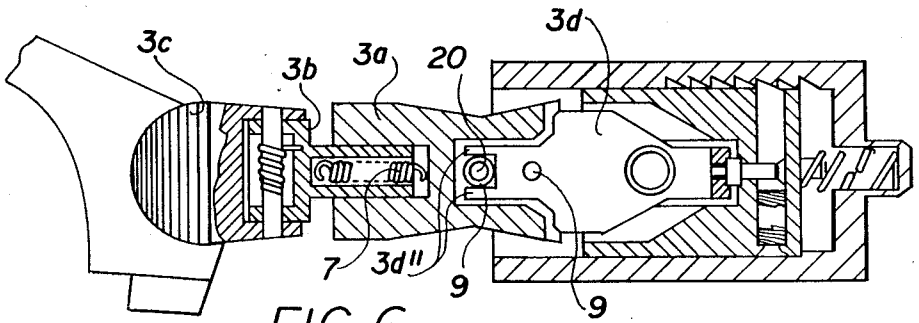
FIG. 6 is a sectional view along the line VI—VI of FIG. 5.
Figure 7:
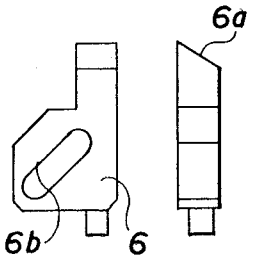
FIG. 7 is a front and lateral view of the locking element.

As shown in FIGS. 5 and 6, the plug part 3 consists of a two-part hoop arm having a first part 3a and a second part 3b, whose parts can be plugged into each other and can be pulled out against the force of a third spring 7 connecting the two parts. The plug part 3 also consists of a socket 3c which is capable of limited rotation. The socket 3c is arranged on the frame of the looking glass 2a and attached thereto with a first pin 17. The second part of the hoop arm 3b is attached in articulated fashion with a socket pin 16 to the socket 3c, and the plug element 3d is attached to the free end of the first part of the hoop arm 3a in moveable fashion by means of a second pin 19. The rotational mobility of the plug element 3d about the second pin 19 is limited by two stops 3d'' which are provided in the plug element 3d and which make damped contact with a third pin 20 surrounded by an elastic ring 9 arranged in the hoop arm 3a. (See FIG. 6).

A torsion spring 8 is provided on the socket pin 16 which interacts with the second part of the hoop arm 3b and moves it automatically towards or against the mask 2. In this way the lateral two-part hoop arm 3a and 3b is forcibly moved close to the mask 2 when the breathing protection mask 2 is not connected to the protective helmet 1 by the user. The hoop arms 3a and 3b are thus protected from damage, on the one hand, and they cannot inflict injuries upon the user, on the other hand.

The plug receptacle part 4 provided in a lateral recess of the protective helmet (not shown) is covered with a cover 18. The cover 18 is provided with a handle part 18a which the user can grasp with his fingers when attaching the mask 2 to the helmet 1, in order to be able to adjust the mask 2 attached to the protective helmet 1 tightly to the surface of the face.

The operation of the connecting element A is described in the following:

The connection of the strapless breathing protection mask 2 with the protective helmet 1 is established in such a way that the user, while wearing the protective helmet inserts the tongue-like plug elements 3d of the breathing protection mask 2 into the plug receptacle part 4. During this process, the leaf spring 14, with the cog 15, arranged in the slide 4b is pressed down by way of the key 11 and the cog 15 engages with spring action and captively into the through-hole 3d' of the plug element 3d. The breathing protection mask 2 is then connected with the protective helmet 1. In order to adjust the edge of the breathing protection mask 2 tightly to the shape of the head and face of the user, the breathing protection mask 2, coupled to the moveable slide 4b, has to be pushed towards the face, whereby the slide 4b in the housing 4a of the plug receptacle part 4 is locked automatically in the respective position by means of the locking element 6. This locking takes place with positive force.

In order to be able to compensate for speaking or facial movements of the wearer or for displacement movements due to possible effects of force on the helmet, the plug part 3 has a certain elasticity and flexibility. This is accomplished, one the one hand, by the fact that the telescoped two-part hoop arm 3a and 3b of the plug part 3 can be pulled out against the force of the spring 7 and can be made longer when the breathing protection mask 2 is adjusted, and on the other hand by the fact that the plug element 3d has limited rotation and makes damped contact with the elastic ring 9, and that the socket 3c of the plug part 3 at the frame of the looking glass 2a of the breathing protection mask 2 also has limited rotation. Thus, the movements between the breathing protection mask 2 and the protective helmet 1 can be compensated for harmonically by the wearer, assuring convenient wear of the two different components now detachably combined to form one unit. Furthermore, no movements coming from the protective helmet 1 are transferred to the breathing protection mask 2, which in the case of the known versions would lead to leaks at the edge of the breathing protection mask 2.

The release of the plug part 3 with the breathing protection mask 2 from the plug receptacle part 4 of the protective helmet 1 is accomplished by pressing down the spring loaded key 11. When this is done, the slide 4b in the housing 4a of the plug receptacle part 4 is released from its locking position and is pushed in a forward direction by the force of the spring 10 into a non-locking position, whereas on the other hand, the cog 15 arranged on the leaf spring 14 moves out of the through-hole 3d' of the plug element 3d and vacates it. The key 11, when it is pressed down, releases two functions simultaneously.

Although the invention has been described in detail in the foregoing embodiments for the purpose of illustration, it is to be understood that such detail is solely for that purpose and that variations can be made therein by those skilled in the art without departing from the spirit and scope of the invention except as it may be described in the following claims.

What is claimed is:

1. A protective helmet with a strapless breathing protection mask in a detachable connection, which is formed by plug-in type and lockable connecting elements arranged on both sides of the helmet and the mask, the improvement comprising:

each connection element having a flexible plug-type part capable of limited rotation, arranged on the breathing protection mask, and of a plug receptacle part arranged on the protective helmet;

the plug receptacle part has an adjusting device which can be adjusted to a number of different positions, and which holds the plug-type part in the plug receptacle part with positive force; and wherein the plug receptacle part includes a housing with U-shaped cross-section and a slide which can move in the housing in longitudinal direction against the force of a first spring disposed in the housing and which constitutes the adjusting device.

2. A protective helmet according to claim 1 wherein the movable locking element under the pressure of a second spring is arranged in the slide transverse to the longitudinal axis of the slide, said locking element having a sawtooth-shaped point that interacts with positive force from the second spring with locking grooves which are provided in the housing and which are correspondingly defined.

3. A protective helmet according to claim 2 wherein there is arranged in the slide a unilaterally supported spring-loaded key which has a pin that engages into a long hole which is provided in slant position in the locking element, said long hole, when the key is pressed down, guides the locking element out of the respective locking grooves, and whereby the slide due to the force of the first spring locks automatically in a different locking groove.

4. A protective helmet according to claim 3 wherein below the key a leaf spring is unilaterally installed in the slide to provide the spring-loading, which with its free end presses against the key and holds it in a resting position 5. A protective helmet according to claim 4 wherein there is arranged on the side of the leaf spring opposite the free end a cog upon which the plug-type part in a tongue-like form acts in order to connect the plug-type part with the plug receptacle part.

6. A protective helmet according to claim 5 wherein the tongue-like plug part has a through-hole into which the cog is captively engaged when the plug element is inserted through an opening in the slide.

7. A protective helmet according to claim 6 wherein the protective breathing mask when coupled to the slide by means of the plug-type part can be moved forward to the face in order to be able to fit the edge of the breathing protection mask tightly to the face of the user, and whereby the slide in the housing of the plug receptacle part is automatically locked in a corresponding position by means of the locking element.

8. A protective helmet according to claim 1 wherein the plug-type part includes a socket which is capable of limited rotation with respect to a second pin and arranged on the breathing protection mask, and a two-part hoop arm having a first part and a second part, whose parts can be plugged into each other and expanded against the force of a second spring which connects the two parts of the hoop arm.

9. A protective helmet according to claim 8 wherein the plug element is arranged in moveable position at the first part of the hoop arm by means of a third pin, whereby the rotational mobility is limited by two stops in the plug element.

10. A protective helmet according to claim 9 wherein the two stops provided in the plug element make damped contact with the third pin surrounded by an elastic ring and arranged in the first part of the hoop arm.

11. A protective helmet according to claim 8 wherein there is disposed on the second pin which provides an articulated connection between the second part of the hoop arm and the socket a torsion spring which is arranged such that it interacts with the two parts of the hoop arms and causes them to make automatic contact with the mask.

12. A protective helmet according to claim 1 wherein the plug receptacle part which is located in a recess at the side of the protective helmet, can be covered with a protective cover.

13. A protective helmet according to claim 12, characterized by the fact that the protective cover is equipped with a handle part.

* * * * *